US009412251B2

(12) United States Patent
Thuersam et al.

(10) Patent No.: US 9,412,251 B2
(45) Date of Patent: Aug. 9, 2016

(54) MONITORING DEVICE FOR MONITORING INACTIVE BEHAVIOR OF A MONITORED PERSON, METHOD AND COMPUTER PROGRAM

(71) Applicant: Robert Bosch GmbH, Stuttgart (DE)

(72) Inventors: Markus Thuersam, Weil Der Stadt (DE); Michael Dambier, Bretten (DE); Roland Klinnert, Horntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/569,167

(22) Filed: Dec. 12, 2014

(65) Prior Publication Data

US 2015/0170497 A1 Jun. 18, 2015

(30) Foreign Application Priority Data

Dec. 16, 2013 (DE) ..... 10 2013 226 035

(51) Int. Cl.
*G08B 21/22* (2006.01)
*G08B 21/04* (2006.01)

(52) U.S. Cl.
CPC ..... *G08B 21/0423* (2013.01); *G08B 21/0415* (2013.01)

(58) Field of Classification Search
CPC ..... G08B 21/0415; G08B 21/0423; G08B 21/04; G08B 21/0438; G08B 21/0476; G08B 21/22; G08B 23/00
USPC ..... 340/573.1, 506, 523, 526, 540, 573.3; 379/38–39; 700/200
See application file for complete search history.

(56) References Cited

U.S. PATENT DOCUMENTS

| | | | | |
|---|---|---|---|---|
| 4,259,548 | A * | 3/1981 | Fahey | H04M 11/04 340/506 |
| 4,524,243 | A * | 6/1985 | Shapiro | G08B 21/0415 340/573.1 |
| 4,743,892 | A * | 5/1988 | Zayle | G08B 21/0469 340/573.4 |
| 2003/0096590 | A1 | 5/2003 | Satoh | |
| 2005/0278409 | A1 | 12/2005 | Kutzik et al. | |
| 2006/0055543 | A1 * | 3/2006 | Ganesh | G08B 21/0423 340/573.1 |

FOREIGN PATENT DOCUMENTS

| | | | |
|---|---|---|---|
| DE | 10 2011 005 013 | A1 | 9/2012 |
| GB | 2 444 107 | A | 5/2008 |
| JP | 2007-24688 | A | 2/2007 |

* cited by examiner

*Primary Examiner* — Hung T Nguyen
(74) *Attorney, Agent, or Firm* — Maginot, Moore & Beck LLP

(57) ABSTRACT

A monitoring device for monitoring inactive behavior of a monitored person in a monitored zone includes a plurality of monitoring sensors configured to record sensor data. The monitoring sensors are positioned in at least two spatially separated monitored subzones of the monitored zone. The monitoring device further includes an evaluation device including a model module and a test module. The model module produces a first inactivity model in a spatially anonymized manner for a first time period with reference to sensor data in the first time period. The model module produces a second inactivity model for a second time period. At least portions of the second time period are formed later than the first time period. The test module compares the first inactivity model and the second inactivity model and provides a change notification if there is a deviation between the first inactivity model and the second inactivity model.

10 Claims, 2 Drawing Sheets

MONITORING DEVICE FOR MONITORING INACTIVE BEHAVIOR OF A MONITORED PERSON, METHOD AND COMPUTER PROGRAM

This application claims priority under 35 U.S.C. §119 to patent application no. DE 10 2013 226 035.0 filed on Dec. 16, 2013 in Germany, the disclosure of which is incorporated herein by reference in its entirety.

The disclosure relates to a monitoring device for monitoring inactive behavior of a monitored person in a monitored zone and a method for using the monitoring device and a computer program comprising a plurality of monitoring sensors for recording sensor data, the monitoring sensors being arranged or arrangeable in at least two spatially separated monitored subzones of the monitored zone, comprising an evaluation means, the evaluation means including a model module for producing a first inactivity model of the monitored person for a first time period and for producing a second inactivity model of the monitored person for a second time period, at least portions of the second time period being formed later than the first time period and the inactivity models being formed on the basis of the sensor data in the respective time periods, the evaluation means including a test module, the test module comparing the first and the second inactivity model and outputting a change notification in the case of deviations.

BACKGROUND

The trend of elderly or needy persons or else of persons with physical or mental disabilities living independently for as long as can be justified evolves unabated. These persons can live independently almost all the time; however, the probability of aid being required is higher than in the case of young or healthy or physically/mentally unburdened persons. In order to be able to offer these persons the highest degree of security and, at the same, comfort, different systems for triggering help signals have become established:

Thus, for example, house emergency systems with emergency warning devices serve to enable these persons to call for help via a communication network in times of need. These house emergency systems usually require manual actuation of the emergency warning device. However, it is also possible to account for emergencies in which the persons themselves are no longer able to actively operate the emergency warning device, for example because these are unable to move or even unconscious as a result of the emergency. To this end, use can be made of e.g. activity buttons in the house emergency system, which need to be pressed at regular time intervals. Therefore, these activity buttons correspond to the so-called dead man's switches, as a used e.g. in work safety or rail vehicles. As an alternative to this, there are means in which active actuation of the activity buttons can be dispensed with and, instead, the activity of the persons is monitored by means of e.g. motion sensors or door contact sensors. Here, an alarm notification is output after a set period of time during which no activity was registered.

Document DE 10 2011 005013 A1, which arguably forms the closest prior art, discloses a monitoring system for monitoring inactive behavior of a monitored person, a method and a corresponding computer program. In the monitoring system, the monitored zone, that is to say e.g. the domicile of the person to be monitored, is divided into at least two monitored rooms, wherein a separate room model for modeling the inactive behavior is provided for each monitored room. As soon as the person to be monitored enters the corresponding room, the room model for monitoring the inactivity, assigned to the room, is started. If the activity data of the monitored person deviates too strongly from the room model, an alarm is emitted.

SUMMARY

A monitoring device comprising the features of the disclosed subject matter, a method comprising the features of the disclosed subject matter and a computer program comprising the features of the disclosed subject matter are proposed within the scope of the disclosure. Preferred or advantageous embodiments of the disclosure emerge from the disclosed subject matter, the following description and the attached figures.

According to the disclosure, a monitoring device is proposed, which is suitable and/or designed for monitoring inactive behavior of a monitored person in a monitored zone. The monitored person can be e.g. an elderly, sick or needy person or a person with health, physical and/or mental disabilities. By way of example, the monitored zone is formed as a domicile and/or living space of the monitored person. Therefore, the monitored zone can be realized as a domicile or as a house.

When monitoring the inactive behavior, a check is carried out as to whether inactivity intervals, i.e. time intervals without activity by the monitored person, are to be assessed as regular or irregular. In particular, the time duration of inactivity intervals is used for monitoring the inactive behavior. By way of example, a check is carried out as to whether the time duration of an inactivity interval is longer than a predetermined, maximum temporal inactivity interval.

The monitoring device comprises a plurality of monitoring sensors which are designed for recording sensor data. The monitoring sensors are designed to detect active behavior of the monitored person as the sensor data, either directly or indirectly. In the case of direct detection, e.g. steps of the monitored person are detected by floor mat sensors. In the case of indirect recording of the activity, the monitoring sensors e.g. detect and use the switching on or off of a light in the monitored zone.

The monitoring sensors are arranged or arrangeable in at least two spatially separated monitored subzones of the monitored zone. The different monitored subzones are, in particular, different rooms in the monitored zone. The monitored subzones, in particular the rooms, are particularly preferably separated from one another by separating means, more particularly doors. At least one of the monitoring sensors is arranged in the one monitored subzone and at least another one of the monitoring sensors is arranged in the second monitored subzone. In an optional complementary manner, the monitored zone can also comprise more monitored subzones. At least one monitoring sensor is particularly preferably arranged in each one of the monitored subzones such that all monitored subzones and/or the monitored zone can be monitored completely and/or without gaps.

The monitoring device comprises an evaluation means, the evaluation means being designed as a data processing machine, in particular as a computer. The evaluation means can particularly preferably be formed locally in the monitored zone such that all sensor data and therefore confidential data in relation to the monitored person remain in the monitored zone. As an alternative to this, the evaluation means can also be formed as a server, e.g. with a web service, such that the evaluation means is arranged decentrally in relation to the monitored zone.

The evaluation means comprises a model module designed to produce a first inactivity model of the monitored person.

Sensor data from a first time period, for which the first inactivity model is learned or trained, serve as basis for the first inactivity model. By way of example, the first inactivity model may be time-based, wherein the inactive behavior of the monitored person is modeled depending on a time of day, a day of the week, a month and/or a season. By way of example, the inactive behavior of the monitored person can be detected statistically. Specifically, it is possible for an average inactivity interval to be determined statistically for certain time periods. In an optional complementary manner, further statistical variables, such as e.g. the standard deviation etc., can be used to form the inactivity model. By way of example, the time profile of average inactivity intervals and the associated standard deviation can be used in the inactivity model for modeling the inactive behavior of the monitored person.

It is possible, and therefore to be expected, that the inactive behavior of the monitored person changes over time. In order to form the monitoring device, in particular the evaluation means, in an adaptive manner, the model module is designed for producing a second, more particularly an updated inactivity model of the monitored person, wherein the second inactivity model is formed for a second time period, at least portions of the second time period extending to a later time than the first time period. It is possible for the first and second time periods to be without overlap in time. Alternatively, it is possible for the first and second time periods to overlap in time. In particular, it is also possible for the second time period to completely include the first time period. In one possible embodiment, the time periods can be designed as e.g. a time window, wherein the two time periods have the same time duration, but are arranged offset to one another in time.

The inactivity models are formed on the basis of the sensor data in the respective time periods. Therefore, the sensor data are used to form model parameters for the inactivity model or the updated inactivity model.

Furthermore, the evaluation means comprises a test module, the test module being designed to compare the first and the second inactivity model and to output a change notification in the case of deviations.

Within the scope of the disclosure, it is proposed that the model module is designed to produce the inactivity models in a spatially anonymized manner. In particular, the model module lifts a spatial resolution of the inactivity models in respect of the monitored zone. Therefore, the resultant inactivity models allow no deductions or no listing of a stay of the monitored person in the monitored subzones.

Here, a consideration of the disclosure is that, although it is positive that the monitored persons are able to be monitored automatically in respect of their inactive behavior within the monitored zone, the monitoring of the monitored persons can also be perceived as an invasion of the privacy which should be respected. For example, it may be embarrassing to the monitored persons if change notifications relating to relatively long inactivity or a relatively long stay in e.g. bathrooms or toilets are output. Here, the intervention intervenes and ensures by way of the model module that the inactivity models are anonymized, in particular encrypted or encoded, in respect of the spatial resolution in the monitored zone. Although this allows conspicuous inactive behavior of the monitored persons to be identified and a corresponding change notification to be output, an invasion of the privacy by the detailed specification of the monitored subzones in which the inactivity took place is not forwarded and privacy is protected thereby.

In one possible embodiment of the disclosure, the model module is designed to produce the resultant inactivity models on the basis of linked sensor data and/or on the basis of linked intermediate data derived from the sensor data and, as a result of this, anonymize these spatially. By way of example, this renders it possible for the sensor data of monitoring sensors from the two monitored subzones to be averaged with one another and for a location of the monitored person in the monitored subzones to be spatially anonymized in this manner.

The sensor data from the monitoring sensors are particularly preferably converted into a neutralized form such that the sensor data in the neutralized form are in each case processed using the same mathematical notation. By way of example, it is possible for the neutralized sensor data only to represent two states, namely active and inactive, e.g. 1 and 0, such that averaging, accumulating or generally linking the neutralized sensor data is mathematically simplified as intermediate data derived from the sensor data.

In principle, it is possible that the linking operation for the sensor data or the data resulting from the sensor data is mathematically reversible. This is disadvantageous in that intuitive consideration of the inactivity models may also make it possible to deduce the location of the monitored person in relation to the monitored subzones. Against this background, it is preferable that the linking operation or operations are irreversible from a mathematical point of view. As a result, the information of the position of the monitored person is completely and irrevocably lost in the monitored subzones such that the privacy is protected.

The inactivity models are preferably described or defined by model parameters, the model parameters of the first and the second inactivity model differing when the first and the second inactivity model differ from one another. By way of example, the first inactivity model is compared to the second inactivity model by comparing the model parameters of the inactivity models.

In one possible embodiment of the disclosure, the model parameters are formed as a time-resolved averaging of the inactivity intervals from at least two sensor signals from the at least two monitored subzones, with at least one of the sensor signals originating from one of the monitored subzones and at least a further sensor signal originating from the other one of the at least two monitored subzones. In an alternative or complementary manner, the model parameters can be a time-resolved average of standard deviations or other statistical variables of the inactivity intervals from at least two sensor signals from the at least two monitored subzones. As a result of this type of signal processing, the goal of protecting the privacy of the monitored person is highlighted.

In a preferred embodiment of the disclosure, the monitoring sensors can be formed from any subset of the following sensors:

- motion sensor,
- door contact sensor, possibly for a plurality of doors,
- floor mat sensor,
- light sensor,
- video camera,
- sensor for actuating a toilet flush,
- sensor for switching on an electrical appliance, in particular stove, television.

In possible embodiments of the disclosure, one of the monitored subzones is assigned to a living area or living quarters and for example designed as a living room or study, and another monitored subzone is assigned to a care zone and for example designed as a toilet or bathroom. As a result, the most important whereabouts are considered in the monitored zone.

It is likewise preferable for the monitored zone to be formed as a domicile or living area in a house. Particularly preferably, each one of the rooms forms a monitored subzone with at least one monitoring sensor. This ensures that inactivity is not erroneously detected when the monitored person is situated in an unmonitored subzone of the monitored zone.

A further subject matter of the disclosure relates to a method for monitoring a monitored person in a monitored zone using the monitoring device as described above, wherein, initially, a first inactivity model and, at a later time, a second inactivity model is produced and wherein the two inactivity models are compared to one another and a change notification is output in the case of deviations.

A last subject matter of the disclosure relates to a computer program comprising the features of the disclosed subject matter.

BRIEF DESCRIPTION OF THE DRAWINGS

Further features, advantages and effects of the disclosure emerge from the following description of a preferred exemplary embodiment of the disclosure, and from the attached figures. Here.

DETAILED DESCRIPTION

Figure 1:
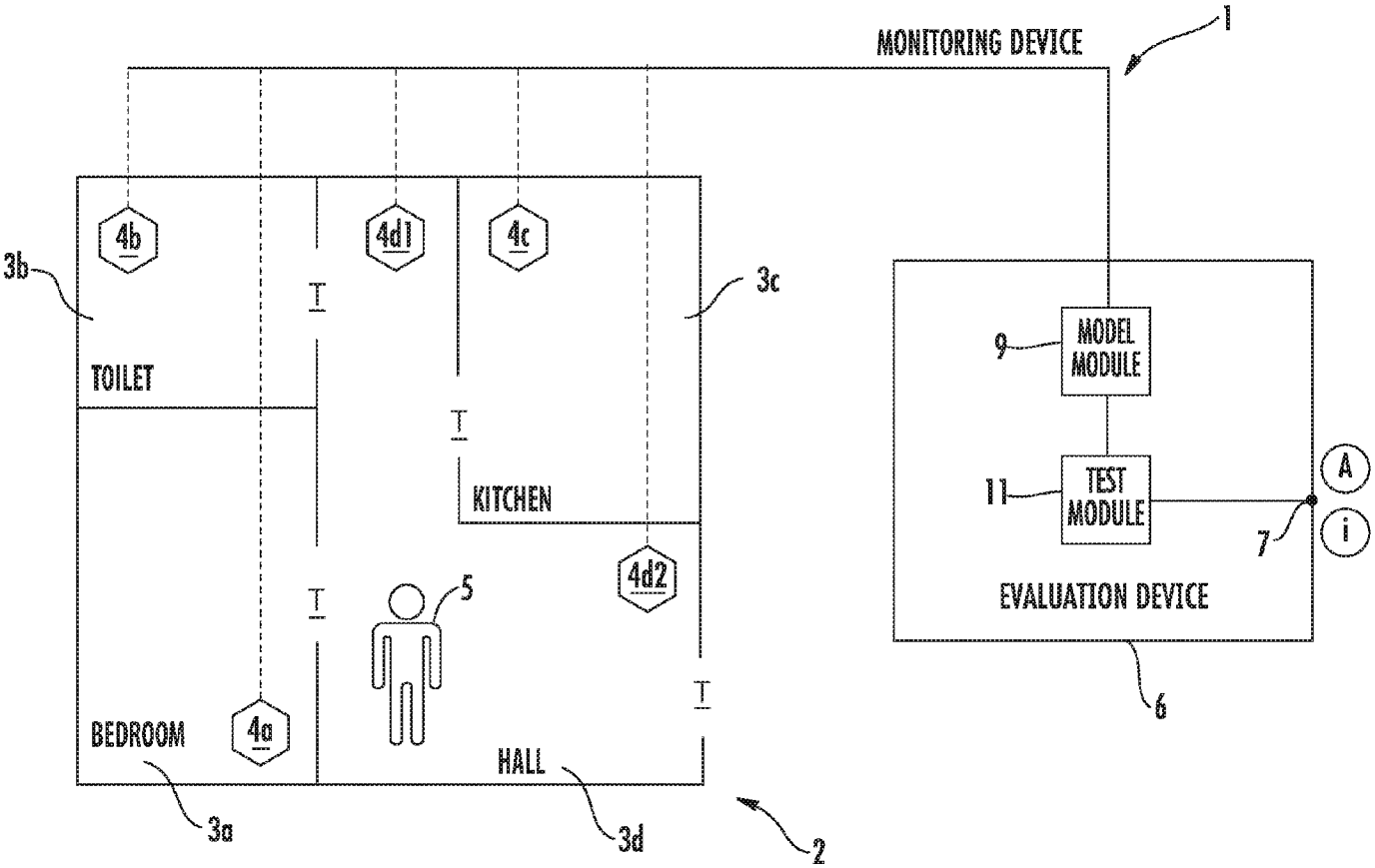
FIG. 1 shows a schematic block diagram of a monitoring device as an exemplary embodiment of the disclosure.

In a schematic block diagram, FIG. 1 shows a monitoring device 1 designed to monitor a monitored zone 2. The monitored zone 2 is formed as a domicile or living area in a house in this example and includes a plurality of rooms 3*a, b, c* and *d*. For the purposes of this explanation, the assumption should be made that room 3*a* is a bedroom, room 3*b* is a toilet, room 3*c* is a kitchen and room 3*d* is a hall.

Each room 3*a*-3*d* forms a separate monitored subzone, said monitored subzones being separated from one another by separation means such as doors T. A monitored person 5, the inactive behavior of whom is intended to be monitored, may be situated in the monitored zone 2. By monitoring the inactive behavior, the safety of the monitored person 5 is ensured to the extent that an emergency situation can be identified automatically when inactivity intervals are too long, as may occur in the case of motionlessness or even unconsciousness, for example.

For the purposes of monitoring the inactive behavior, a plurality of monitoring sensors 4*a*, 4*b*, 4*c*, 4*d*1, 4*d*2 are distributed in the monitored zone 2. In particular, at least one monitoring sensor 4*a*-*d*2 is arranged in each room 3*a*-3*d* and therefore in each monitored subzone. As a result, the monitored zone 2 is monitored completely, in particular over the whole area thereof, in respect of the inactive behavior of the monitored person 5.

The sensor data from the monitoring sensors 4*a*-*d*2 are fed to an evaluation means 6, which evaluates the sensor data and—when there is a corresponding deviation in the inactive behavior of the monitored person 5—outputs a change notification A, for example via an interface 7, e.g. via the telephone, the Internet. In an optional complementary manner, further information i for explaining why the change notification A was triggered is output via this interface 7 with the change notification A.

Figure 2:
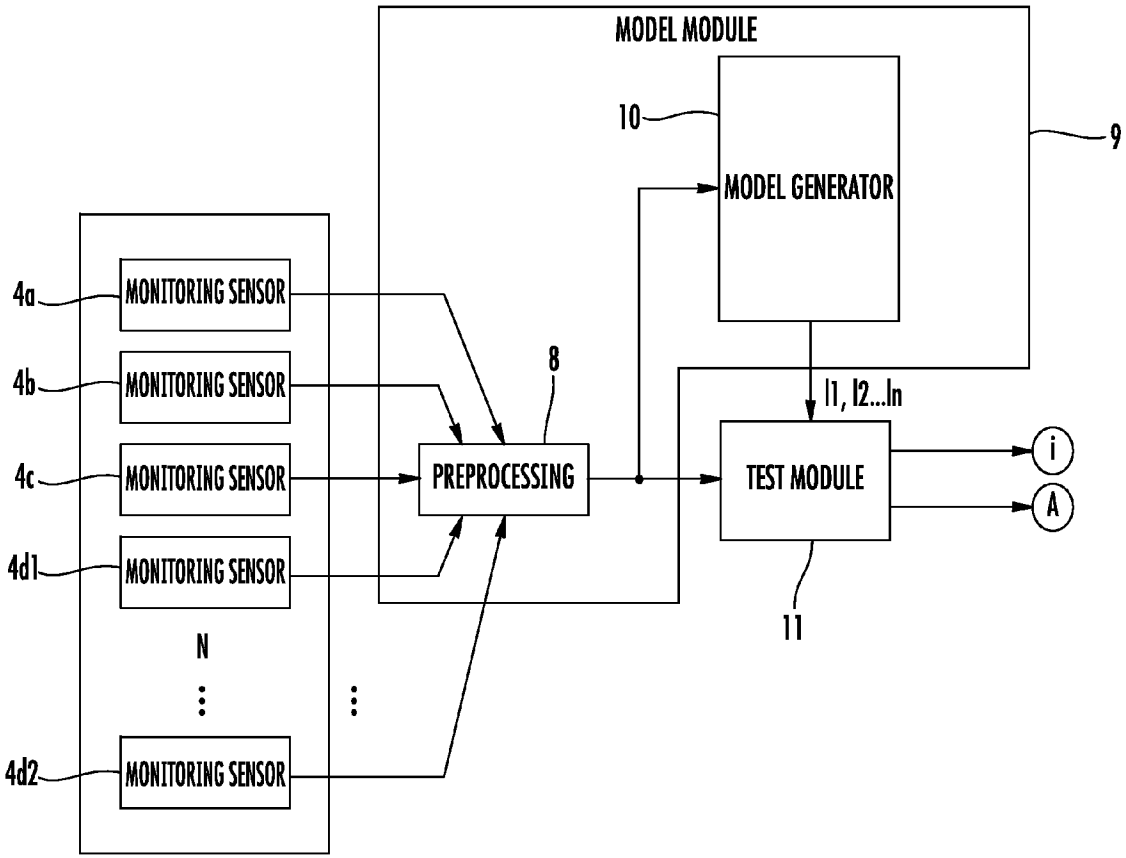
FIG. 2 shows a flowchart for depicting the data streams in the monitoring device from FIG. 1.

In order to explain the data processing, reference is made to FIG. 2 which shows a schematic flowchart of the data streams in the monitoring device 1 in FIG. 1:

Proceeding from a number of N monitoring sensors 4*a*-4*d*2, the sensor data or already intermediate data, which are derived from the sensor data, are linked to one another during preprocessing 8 in a model module 9. Here, provision can be made for the sensor data to be converted into normalized sensor data in a first intermediate step, with the time-dependent, normalized sensor data still indicating activity and inactivity only. Alternatively, it may be possible to examine the sensor data, intermediate data or normalized sensor data for inactivity intervals and form further intermediate data from the time profile or the time distribution of the inactivity intervals. When linking the sensor data or the intermediate data, the sensor data, means of the sensor data, standard deviations of the sensor data or other statistical data on the basis of the sensor data can be linked to one another.

The data linked in this manner are used in a model generator 10 for producing a first inactivity model I1. What is ensured by linking the sensor data, the normalized sensor data or the intermediate data is that the inactivity model I1 permits no conclusions to be drawn with regard to the spatial position of the monitored person 5.

Current data from the preprocessing 8 are tested against the current inactivity model I1 in a test module 11 and an alarm is emitted in the case of deviations. As a result of this monitoring, changes in the inactive behavior of the monitored person 5 are determinable at short notice and can be processed further in the form of an alarm.

Since the behavior of the monitored person 5 can change over time, a second inactivity model I2 is produced in the same manner at a subsequent time and, following this, further inactivity models are produced in the same manner, with the subsequent inactivity models I2 . . . In representing updates of the respective preceding inactivity model I1.

The inactivity models I1, I2 . . . In are compared to one another in the test module 10. Therefore, for example, the second inactivity model I2 is compared to the first inactivity model I1 or—expressed more generally—the (n+1)-th inactivity model In+1 is compared to the n-th inactivity model In. During the comparison, it is possible, for example, to compare model parameters of the inactivity models I1, I2 . . . In to one another. When the inactivity models deviate from one another, the change notification A is output, optionally complemented by the information i. By comparing the inactivity models I1, I2 . . . In, it is possible, in particular, to identify long-term changes in the behavior of the monitored person 5. The change notification A can be forwarded, optionally supplemented with the information i, to care staff or a medical provision.

The advantage of the monitoring device 1 lies in the fact that when the change notification A and the optional supplemented information i is output, the preprocessing 8 of the sensor data means that no information is output in relation to the spatial assignment of the inactivity intervals to the monitored subzones, i.e. the rooms 3*a*-3*d*, and so the privacy of the monitored person 5 is protected.

LIST OF REFERENCE SYMBOLS

1 Monitoring device
2 Monitored zone
3*a, b, c, d* Rooms
T Doors
4*a, b, c, d*1, *d*2 Monitoring sensors
5 Monitored person
6 Evaluation means
7 Interface
8 Preprocessing
9 Model module
10 Model generator 11 Test module
A Change notification
I Information

What is claimed is:

1. A monitoring device for monitoring inactive behavior of a monitored person in a monitored zone, comprising:
a plurality of monitoring sensors configured to record sensor data, the plurality of monitoring sensors positioned in at least two spatially separated monitored subzones of the monitored zone;
an evaluation device including a model module and a test module,
wherein the model module is configured to:
produce a first inactivity model of the monitored person in a spatially anonymized manner for a first time period with reference to sensor data in the first time period,
produce a second inactivity model of the monitored person in the spatially anonymized manner for a second time period with reference to sensor data in the second time period, wherein at least portions of the second time period are formed later than the first time period, and
wherein the test module is configured to:
compare the first inactivity model and the second inactivity model and
provide a change notification if there is a deviation between the first inactivity model and the second inactivity model.

2. The monitoring device according to claim 1, wherein the model module is further configured to:
produce the first inactivity model and the second inactivity model with reference to at least one of (i) a linked sensor data and (ii) a linked intermediate data derived from the sensor data; and
anonymize the first inactivity model and the second inactivity model spatially.

3. The monitoring device according to claim 2, wherein the linking operation is irreversible.

4. The monitoring device according claim 1, wherein the test module is further configured to:
compare model parameters of the first inactivity model and the second inactivity model.

5. The monitoring device according to claim 4, wherein the model parameters are formed by (i) a time-resolved averaging of intermediate data from at least two sensor signals from the at least two monitored subzones or (ii) a time-resolved averaging of standard deviations of intermediate data from the at least two sensor signals from the at least two monitored subzones.

6. The monitoring device according claim 1, wherein the monitoring sensors includes a subset of a contact sensor, video camera, floor mat sensor, light sensor, motion sensor, door contact sensor, sensor for actuating a toilet flush, and sensor for switching on an electrical device.

7. The monitoring device according claim 1, wherein one of the at least two monitored subzones is a living room or study and another of the at least two monitored subzone is a toilet or bathroom.

8. The monitoring device according claim 1, wherein the monitored zone is a domicile or a living area in a house, the domicile or the living area includes rooms, and each room of the rooms form a monitored subzone and have at least one monitoring sensor of the plurality of monitoring sensors.

9. A method for monitoring a monitored zone comprising:
recording sensor data using a plurality of monitoring sensors, wherein the plurality of monitoring sensors being positioned in at least two spatially separated monitored subzones of the monitored zone;
producing, using a model module, a first inactivity model of the monitored person in a spatially anonymized manner for a first time period with reference to sensor data in the first time period, wherein an evaluation device includes the model module;
producing, using the model module, a second inactivity model of the monitored person in the spatially anonymized manner for a second time period with reference to sensor data in the second time period, wherein at least portions of the second time period are formed later than the first time period and the second inactivity model is produced at a later time than the first inactivity model;
comparing, using a test module, the first inactivity model and the second inactivity model, wherein the evaluation device further includes the test module; and
providing, using the test module, a change notification if there is a deviation between the first inactivity model and the second inactivity model.

10. A computer program, comprising:
a program code configured to carry out a method when the method is executed on a monitoring device, the method comprising:
recording sensor data using a plurality of monitoring sensors, wherein the plurality of monitoring sensors being positioned in at least two spatially separated monitored subzones of the monitored zone and the monitoring device includes the plurality of monitoring sensors;
producing, using a model module, a first inactivity model of the monitored person in a spatially anonymized manner for a first time period with reference to sensor data in the first time period, the monitoring device includes an evaluation device and the evaluation device has the model module and;
producing, using the model module, a second inactivity model of the monitored person in the spatially anonymized manner for a second time period with reference to sensor data in the second time period, wherein at least portions of the second time period are formed later than the first time period and the second inactivity model is produced at a later time than the first inactivity model;
comparing, using a test module, the first inactivity model and the second inactivity model, wherein the evaluation device further has the test module; and
providing, using the test module, a change notification if there is a deviation between the first inactivity model and the second inactivity model.

* * * * *